US007504779B2

(12) United States Patent
Roh et al.

(10) Patent No.: US 7,504,779 B2
(45) Date of Patent: Mar. 17, 2009

(54) PLASMA DISPLAY PANEL SUSTAIN DRIVER HAVING DECREASED FLYWHEEL CURRENT

(75) Inventors: Chung-wook Roh, Seoul (KR); Sang-hoon Lee, Ulsan Metropolitan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 654 days.

(21) Appl. No.: 10/888,001

(22) Filed: Jul. 12, 2004

(65) Prior Publication Data

US 2005/0029960 A1 Feb. 10, 2005

(30) Foreign Application Priority Data

Aug. 6, 2003 (KR) ..... 10-2003-0054343

(51) Int. Cl.
*G09G 3/10* (2006.01)

(52) U.S. Cl. ..... 315/169.4; 345/62

(58) Field of Classification Search ..... 345/68, 345/69, 70–72, 60–67, 169.3; 315/169.4; 313/581–587; 438/689
See application file for complete search history.

(56) References Cited

U.S. PATENT DOCUMENTS 4,886,349 A 12/1989 Willis
5,828,353 A 10/1998 Kishi et al.
2001/0029102 A1* 10/2001 Okamura et al. ..... 438/689
2003/0006716 A1* 1/2003 Chae ..... 315/169.3
2003/0025459 A1* 2/2003 Lee et al. ..... 315/169.3

FOREIGN PATENT DOCUMENTS

KR 2001-0078587 A 8/2001

* cited by examiner

*Primary Examiner*—Amare Mengistu
*Assistant Examiner*—Yuk Chow
(74) *Attorney, Agent, or Firm*—Sughrue Mion, PLLC

(57) ABSTRACT

A plasma display panel sustain driver that has a decreased flywheel current. The plasma display panel sustain driver includes a power recovery capacitor that provides a predetermined voltage to the plasma display panel; a sustain switching unit connected to the plasma display panel and that sustains or discharges the voltage charged in the plasma display panel; a first power recovery unit connected between the power recovery capacitor and sustain switching unit, the first power recovery unit forming a resonant circuit together with the plasma display panel to provide a voltage charged in the power recovery capacitor to the plasma display panel through the sustain switching unit when the sustain switching unit is inactivated, the first power recovery unit blocking the output current of the sustain switching unit when the sustain switching unit is activated; and a second power recovery unit connected between the power recovery capacitor and sustain switching unit, the second power recovery unit forming a resonant circuit together with the plasma display panel to discharge the voltage charged in the plasma display panel to the power recovery capacitor when the sustain switching unit is inactivated, the second power recovery unit blocking a current path to the sustain switching unit when the sustain switching unit is activated.

17 Claims, 13 Drawing Sheets

PRIOR ART

PRIOR ART

PRIOR ART

PRIOR ART

PLASMA DISPLAY PANEL SUSTAIN DRIVER HAVING DECREASED FLYWHEEL CURRENT

BACKGROUND OF THE INVENTION

This application claims priority from Korean Patent Application No. 2003-54343, filed on Aug. 6, 2003, in the Korean Intellectual Property Office, the disclosure of which is incorporated herein in its entirety by reference.

1. Field of the Invention

The present invention relates to a plasma display panel sustain driver and, more particularly, to a plasma display panel sustain driver having a decreased flywheel current that is generated when a plasma display panel is driven.

2. Description of the Related Art

A plasma display panel displays characters or images using plasma that is generated by gas discharge. A plasma display panel sustain driver is used to drive the plasma display panel.

FIG. 1 is a circuit diagram of a plasma display panel sustain driver 101 connected to a plasma display panel 111, disclosed in U.S. Pat. No. 4,886,349. Referring to FIG. 1, the plasma display panel sustain driver 101 includes a capacitor Cc, MOS transistors Sr, Sf, Su and Sd, diodes Dr, Df, D1 and D2, and an inductor L. A terminal 121 is connected to another plasma display panel sustain driver (not shown).

The plasma display panel sustain driver 101 operates in four modes M1, M2, M3 and M4. The waveform of a voltage Vp applied to the plasma display panel 111 and the waveform of a current iL flowing through the inductor L for the four modes M1, M2, M3 and M4 are shown in FIG. 2. As shown in FIG. 2, large flywheel currents if1 and if2 flow through the inductor L in the second and fourth modes M2 and M4, respectively.

The flywheel current if1 flows from the MOS transistor Su to the diode D1 through the inductor L when the MOS transistor Su is turned on in the second mode M2. The flywheel current if2 flows from the diode D2 to the MOS transistor Sd through the inductor L when the MOS transistor Sd is turned on in the fourth mode M4.

The MOS transistors Su and Sd are placed under high current stress because of the large flywheel currents if1 and if2. Thus, the MOS transistors Su and Sd should have high current specifications. It the MOS transistors Su and Sd have high current specifications they are relatively large in physical size, resulting in an increase in the size and cost of the plasma display panel sustain driver 101.

Furthermore, between of the large flywheel currents if1 and if2, the power consumption of the MOS transistors Su and Sd is large. Thus, the power consumption of the plasma display panel sustain driver 101 is also large.

FIG. 3 is a circuit diagram of a plasma display panel sustain driver 301 connected to a plasma display panel 311, which is disclosed in U.S. Pat. No. 5,828,353. Referring to FIG. 3, the plasma display panel sustain driver 301 includes a capacitor Cc, MOS transistors Sf, Sr, Su and Sd, diodes Df, D11, D12, Dr, D21, D22, Du and Dd, and inductors L1 and L2. A terminal 321 is connected to another plasma display panel sustain driver (not shown).

The operation of the plasma display panel sustain driver 301 is similar to that of the plasma display panel sustain driver 101 shown in FIG. 1, and the waveforms of a voltage Vp applied to the plasma display panel 311 and a current flowing through the inductors L1 and L2 are similar to those shown in FIG. 2.

Flywheel currents (if1 and if2 in FIG. 2) are generated by the inductors L1 and L2 and they cause high current stress in the MOS transistors Su and Sd. Accordingly, the size and cost of the plasma display panel sustain driver 301 are remarkably increased and the power consumption of the panel is also increased.

FIG. 4 is a circuit diagram of a plasma display panel sustain driver 401 connected to a plasma display panel 411, which is disclosed in Japanese Patent No. 2002-62843A. Referring to FIG. 4, the plasma display panel sustain driver 401 includes MOS transistors Sr, Sf, Su1, Su2, Sd1, Sd2, Sa and Sb, diodes Dr, Df, D11, D12, D21, D22, D31, D32, Da and Db, capacitors Cd and Cd, and inductors Lr and Lf. A terminal 421 is connected to another plasma display panel sustain driver (not shown).

The plasma display panel sustain driver 401 operates in six modes M1 through M6. The waveform of a voltage Vp applied to the plasma display panel 411 and the waveform of currents iLr and iLf flowing through the inductors Lr and Lf for the six modes M1 through M6 are shown in FIG. 5. As shown in FIG. 5, large flywheel currents if1 and if2 flow through the inductors Lf and Lr in the second and fifth modes M2 and M5, respectively.

The flywheel current if1 flows from the MOS transistor Su2 to the diode D21 through the inductor Lr when the MOS transistor Su2 is turned on in the second mode M2. The flywheel current if2 flows from the diode D22 to the MOS transistor Sd2 through the inductor Lf when the MOS transistor Sd2 is turned on in the fifth mode M5.

The MOS transistors Su2 and Sd2 are placed under high current stress because of the large flywheel currents if1 and if2. Accordingly, the size and cost of the plasma display panel sustain driver 401 are increased and its power consumption is also increased.

SUMMARY OF THE INVENTION

The present invention provides a plasma display panel sustain driver that has a decreased flywheel current.

According to an aspect of the present invention, there is provided a plasma display panel sustain driver that drives a plasma display panel, including a power recovery capacitor that provides a predetermined voltage to the plasma display panel, a sustain switching unit that is connected to the plasma display panel and sustains or discharges the voltage stored in the plasma display panel, a first power recovery unit connected between the power recovery capacitor and the sustain switching unit, and a second power recovery unit connected between the power recovery capacitor and the sustain switching unit. The first power recovery unit forms a resonant circuit with the plasma display panel to provide a voltage stored in the power recovery capacitor to the plasma display panel through the sustain switching unit when the sustain switching unit is deactivated. The first power recovery unit blocks the output current of the sustain switching unit when the sustain switching unit is activated. The second power recovery unit forms a resonant circuit with the plasma display panel to discharge the voltage stored in the plasma display panel to the power recovery capacitor when the sustain switching unit is deactivated. The second power recovery unit blocks current to the sustain switching unit when the sustain switching unit is activated.

According to another aspect of the present invention, there is provided a plasma display panel sustain driver that drives a plasma display panel, including a power recovery capacitor that provides a predetermined voltage to the plasma display panel; a sustain switching unit that is connected to the plasma display panel and sustains or discharges the voltage stored in the plasma display panel, and a first power recovery unit including a first MOS transistor connected between the power recovery capacitor and a first node, a first inductor connected between the first node and a second node, a first diode connected between the first node and a ground voltage, a second diode connected between the second node and the ground voltage, and a third diode connected between the second node and the sustain switching unit. The first and second diodes are biased towards ground voltage, and the third diode is biased away from the sustain switching unit. The plasma display panel sustain driver further includes a second power recovery unit including a second MOS transistor connected between the power recovery capacitor and a third node, a second inductor connected between the third node and a fourth node, a fourth diode connected between the third node and a power supply voltage, a fifth diode connected between the fourth node and the power supply voltage, and a sixth diode connected between the fourth node and the sustain switching unit. The fourth and fifth diodes are biased away from the power supply voltage, and the sixth diode is biased to ward the sustain switching unit.

According to another aspect of the present invention, there is provided a plasma display panel sustain driver that drives a plasma display panel, including a power recovery capacitor that provides a predetermined voltage to the plasma display panel, a sustain switching unit that is connected to the plasma display panel and sustains or discharges the voltage stored in the plasma display panel, and a first power recovery unit including a first MOS transistor connected between the power recovery capacitor and a first node, a first inductor connected between the first node and a second node, a first diode connected between the first node and a ground voltage, a second diode connected between the second node and the ground voltage, and a third diode connected between the second node and the sustain switching unit. The first and second diodes are biased towards ground voltage, and the third diode is biased away from the sustain switching unit. The plasma display panel sustain driver further including a second power recovery unit including a second MOS transistor connected between the power recovery capacitor and a third node, a second inductor connected between the third node and a fourth node, a fourth diode connected between the third node and a power supply voltage, a fifth diode connected between the fourth node and the power supply voltage, and a sixth diode connected between the fourth node and the sustain switching unit. The fourth and fifth diodes are biased away from the power supply voltage, and the sixth diode is biased toward the sustain switching unit.

The sustain switching unit includes a lower MOS transistor connected between the third diode and the power supply voltage, a lower diode connected between the third diode and the plasma display panel, an upper MOS transistor connected between the sixth diode and the ground voltage, and an upper diode connected between the sixth diode and the plasma display panel.

According to another aspect of the present invention, there is provided a plasma display panel sustain driver that drives a plasma display panel, including first and second power recovery capacitors that provide predetermined voltages, a ground unit that provides a ground voltage; a sustain switching unit that is connected to the plasma display panel, the ground unit, first and second power recovery capacitors and sustains or discharges a voltage stored in the plasma display panel; and a first power recovery unit including a first MOS transistor connected between the first and second power recovery capacitors and a first node, a first inductor connected between the first node and a second node, a first diode connected between the first node and the ground unit, a second diode connected between the second node and the ground unit, and a third diode connected between the second node and a sixth node of the sustain switching unit. The first and second diodes are biased towards ground voltage, and the third diode is biased away from the sixth node of the sustain switching unit. The plasma display panel sustain driver further including a second power recovery unit including a second MOS transistor connected between the first and second power recovery capacitors and a third node, a second inductor connected between the third node and a fourth node, a fourth diode connected between the third node and a fifth node of the sustain switching unit, a fifth diode connected between the fourth node and the fifth node of the sustain switching unit, and a sixth diode connected between the fourth node and an eighth node of the sustain switching unit. The fourth and fifth diodes are biased away from the fifth node of the sustain switching unit, and the sixth diode is biased towards the eighth node of the sustain switching unit.

The sustain switching unit includes a first upper MOS transistor connected between a power supply voltage and the fifth node, a second upper MOS transistor connected between the fifth and sixth nodes, an upper diode connected between the sixth node and a seventh node, a first lower MOS transistor connected between the ground voltage and the fifth node, a second lower MOS transistor connected between the ground unit and the eighth node, and a lower diode connected between the seventh and eighth nodes. The seventh node is connected to the plasma display panel.

According to the present invention, a flywheel current is greatly reduced.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
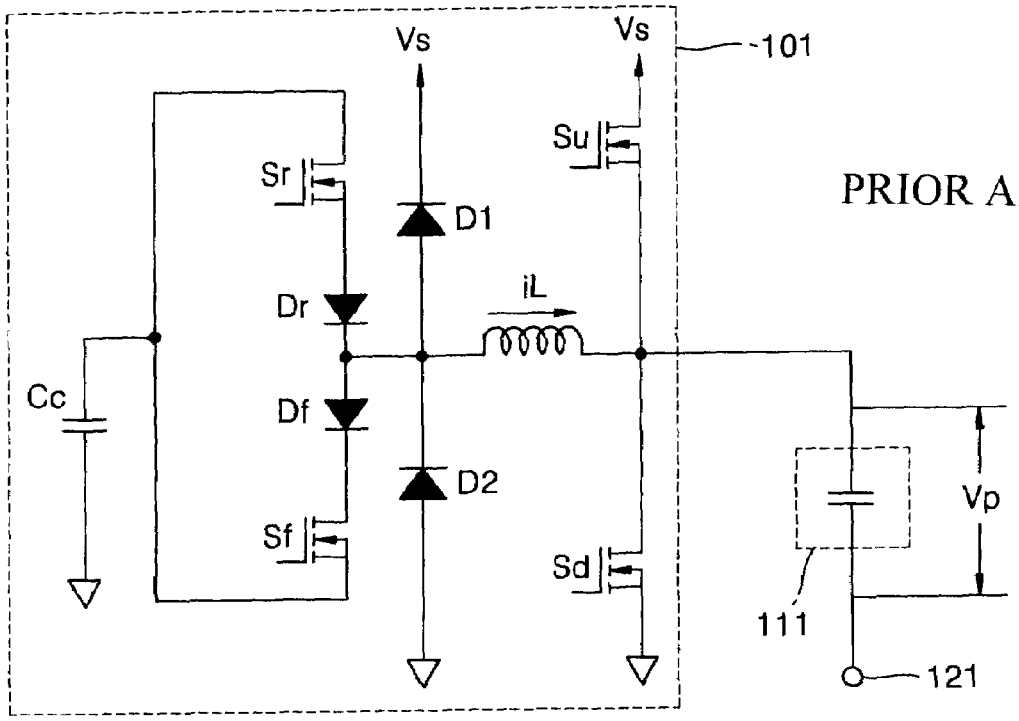
FIG. 1 is a circuit diagram of a prior art plasma display panel sustain driver connected to a plasma display panel.
Figure 2:
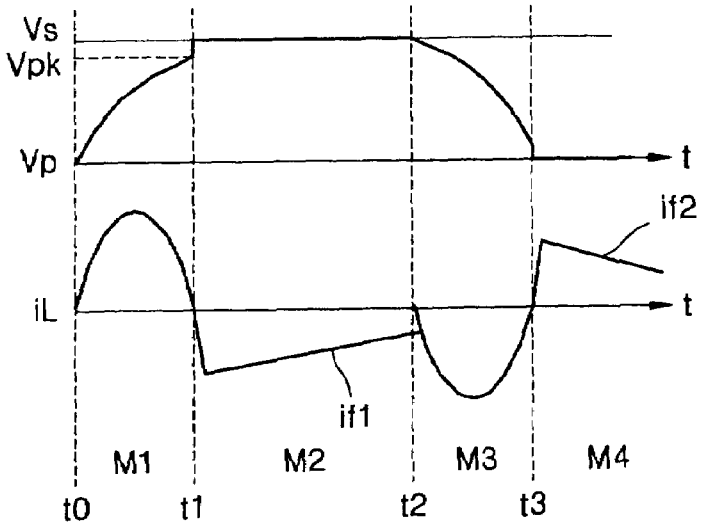
PRIOR ART FIG. 2
FIG. 2 shows voltage and current waveforms of the circuit shown in FIG. 1.
Figure 3:
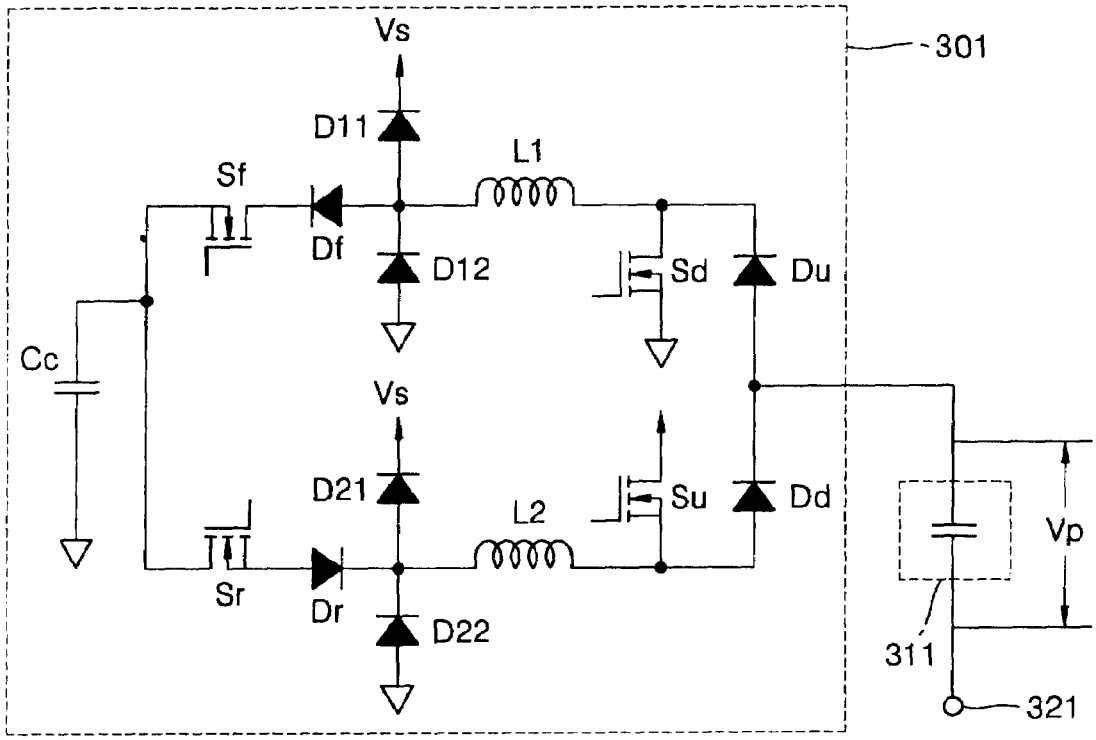
FIG. 3 is a circuit diagram of a prior art plasma display panel sustain driver connected to a plasma display panel.

The present invention will now be described more fully with reference to the accompanying drawings, in which exemplary embodiments of the invention are shown. This invention may, however, be embodied in many different forms and should not be construed as being limited to the embodiments set forth herein; rather, these embodiments are provided so that this disclosure will be thorough and complete, and will fully convey the concept of the invention to those skilled in the art. Throughout the drawings, like reference numerals refer to like elements.

Figure 6:
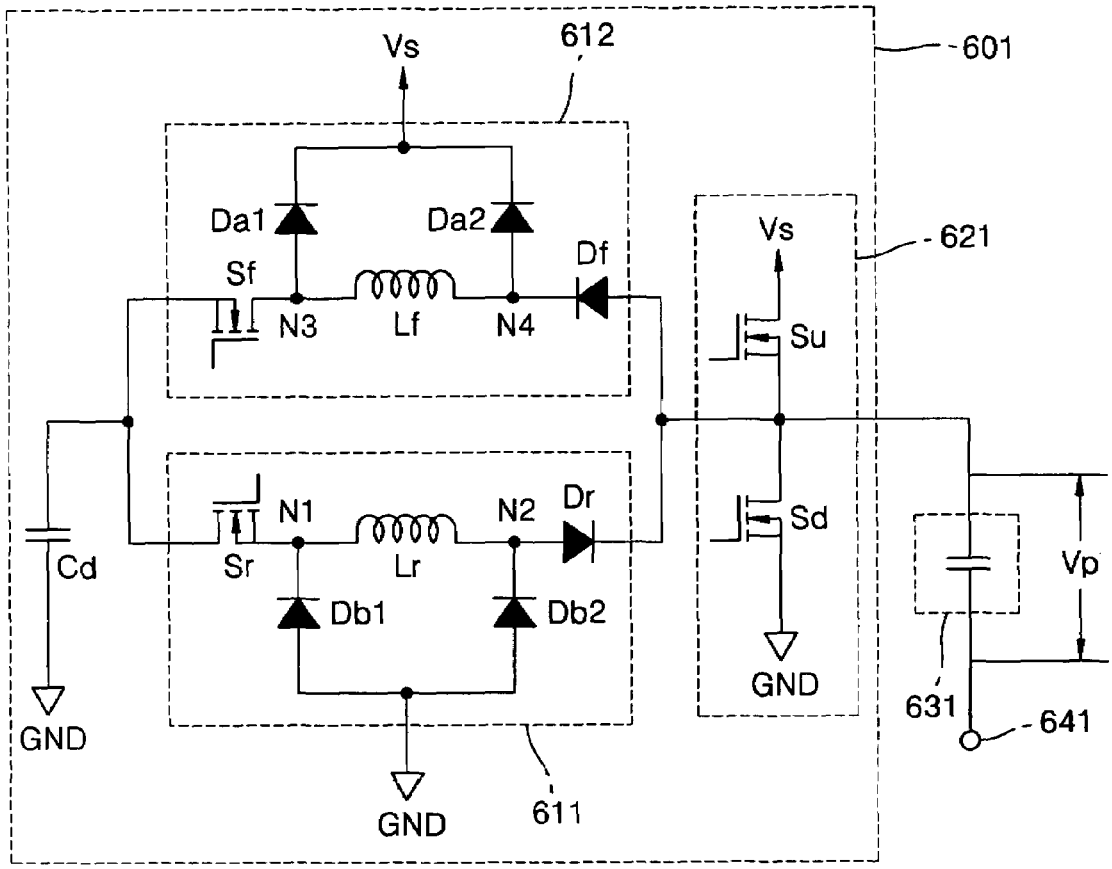
FIG. 6 is a circuit diagram of a plasma display panel sustain driver connected to a plasma display panel according to a first embodiment of the present invention.

FIG. 6 is a circuit diagram of a plasma display panel sustain driver 601 connected to a plasma display panel 631 according to a first embodiment of the present invention. Referring to FIG. 6, the plasma display panel sustain driver 601 includes a power recovery capacitor Cd, a first power recovery unit 611, a second power recovery unit 612, and a sustain switching unit 621. A terminal 641 is connected to the same device as the plasma display panel sustain driver 601.

The power recovery capacitor Cd is charged to a predetermined voltage Vs/2. The sustain switching unit 621 is connected to the plasma display panel 631 and sustains or discharges a voltage charged in the plasma display panel 631. The sustain switching unit 621 includes an upper MOS transistor Su connected to a power supply voltage Vs and a lower MOS transistor Sd connected to a ground voltage GND. When the upper MOS transistor Su is turned on, a current path routed from the upper MOS transistor Su to the plasma display panel 631 is formed. When the lower MOS transistor Sd is turned on, a current path routed from the plasma display panel 631 to the lower MOS transistor Sd is formed.

While either NMOS transistors or PMOS transistors can be used as the upper and lower MOS transistors, it is preferable to use NMOS transistors as the upper and lower MOS transistors.

The first power recovery unit 611 is connected between the power recovery capacitor Cd and sustain switching unit 621. When the sustain switching unit 621 is deactivated, the first power recovery unit 611 forms a resonant circuit together with the plasma display panel 631 to provide a voltage in the power recovery capacitor Cd to the plasma display panel 631 through the sustain switching unit 621. When the sustain switching unit 621 is activated, the first power recovery unit 611 blocks an output current of the sustain switching unit 621.

The first power recovery unit 611 includes a first MOS transistor Sr connected between the power recovery capacitor Cd and a first node N1, a first inductor Lr connected between the first node N1 and a second node N2, a first diode Db1 connected between the first node N1 and the ground voltage GND, a second diode Db2 connected between the second node N2 and the ground voltage GND, and a third diode Dr connected between the second node N2 and the sustain switching unit 621.

The second power recovery unit 612 is connected between the power recovery capacitor Cd and the sustain switching unit 621. When the sustain switching unit 621 is deactivated, the second power recovery unit 612 forms a resonant circuit together with the plasma display panel 631 to provide a voltage of the plasma display panel 631 to the power recovery capacitor Cd. When the sustain switching unit 621 is activated, the second power recovery unit 621 prevents a current from passing through the sustain switching unit 621.

The second power recovery unit 612 includes a second MOS transistor Sf connected between the power recovery capacitor Cd and a third node N3, a second inductor Lf connected between the third node N3 and a fourth node N4, a fourth diode Da1 connected between the third node N3 and the power supply voltage Vs, a fifth diode Da2 connected between the fourth node N4 and the power supply voltage Vs, and a sixth diode Df connected between the fourth node N4 and the sustain switching unit 621.

Figure 7A:
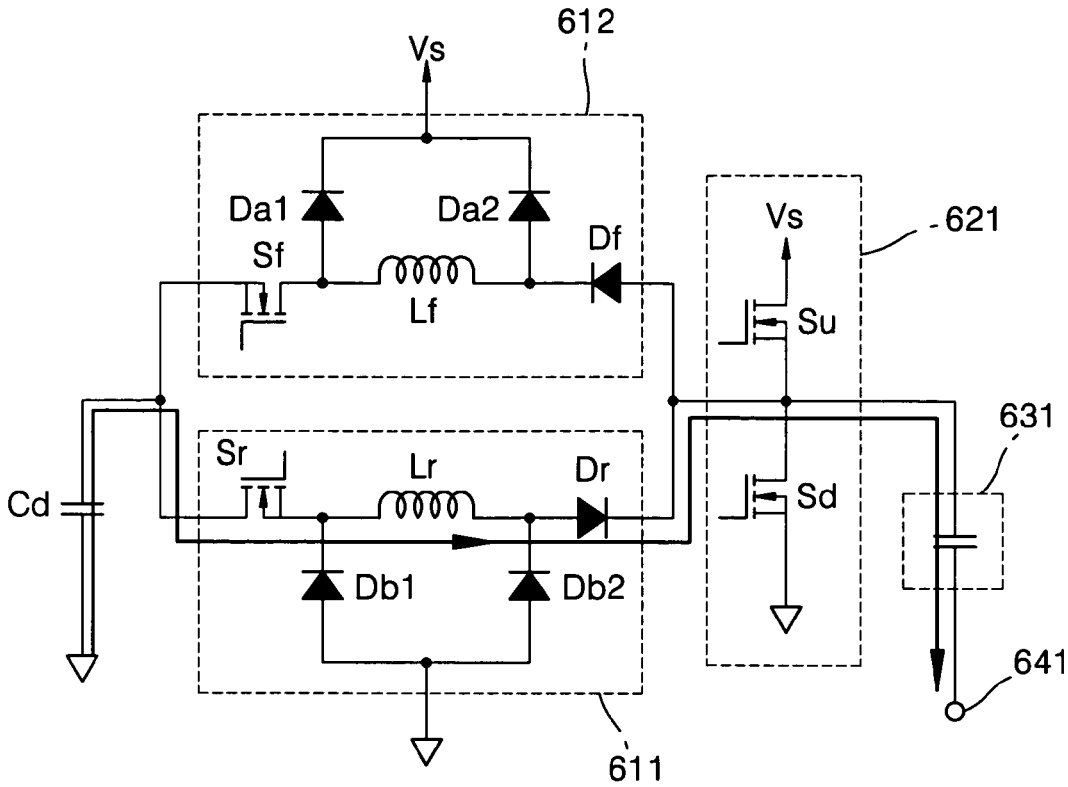
FIGS. 7A through 7D are circuit diagrams showing current paths for modes of the circuit shown in FIG. 6.
Figure 7B:
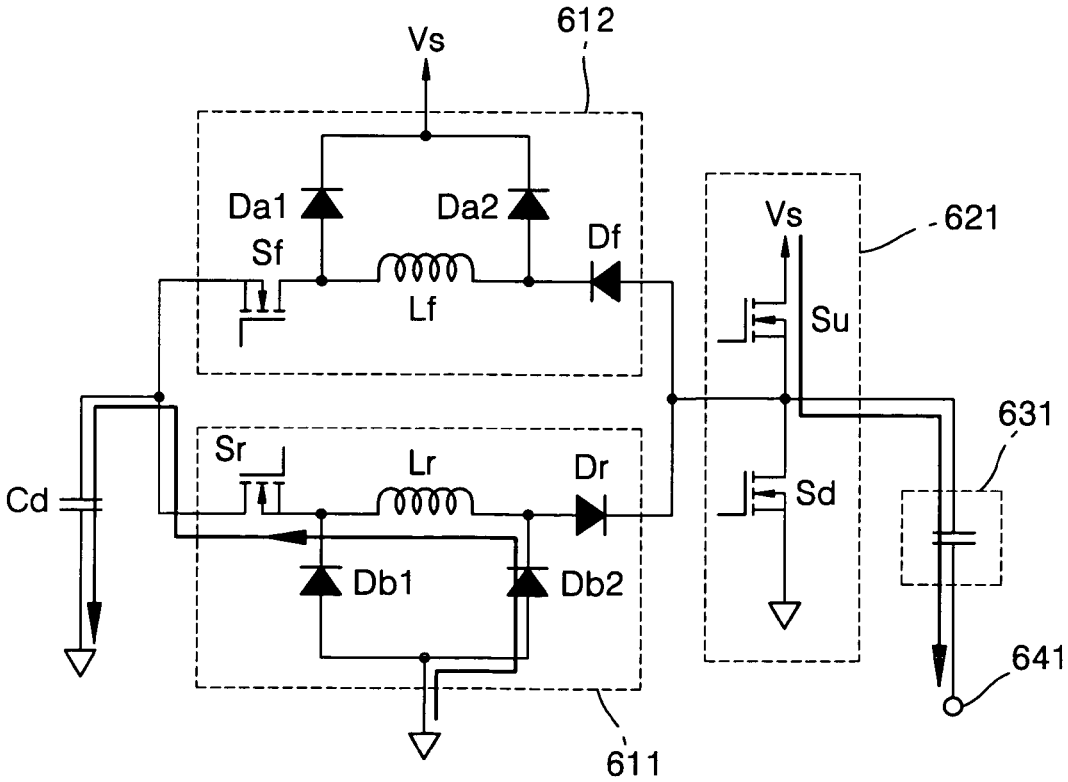
Figure 7C:
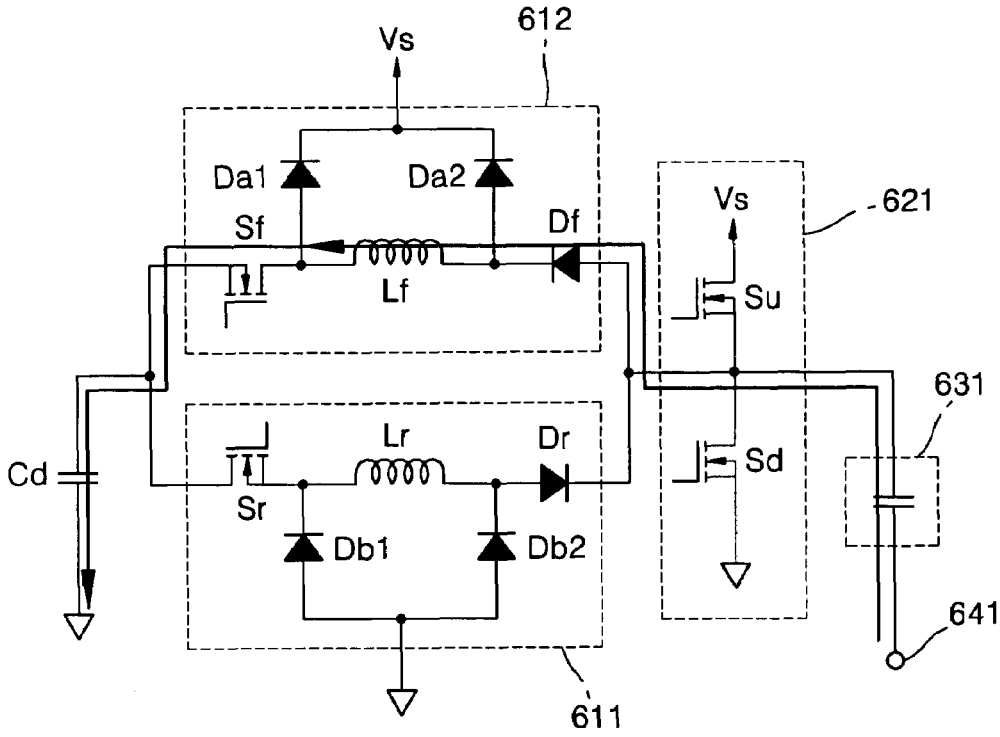
Figure 7D:
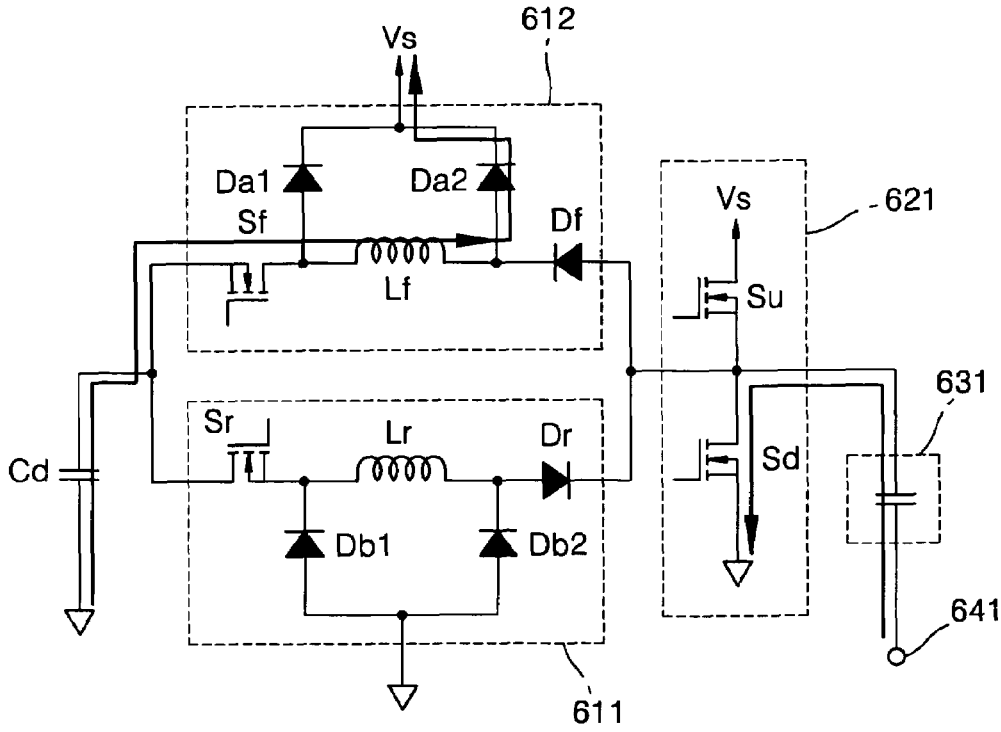
Figure 8:
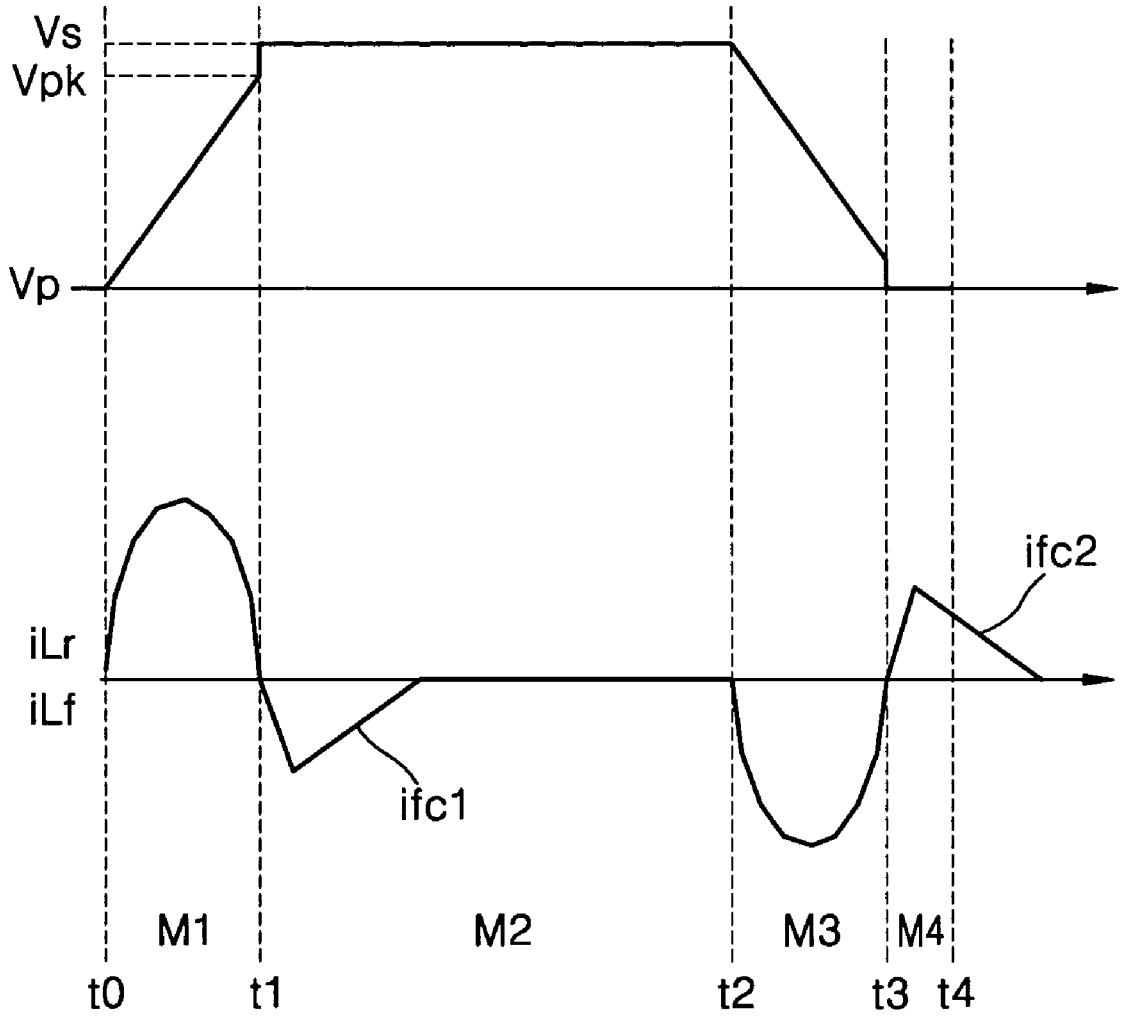
FIG. 8 shows voltage and current waveforms of the circuit shown in FIG. 6.

FIGS. 7A, 7B, 7C and 7D are circuit diagrams showing current paths for modes of the circuit shown in FIG. 6, and FIG. 8 shows voltage and current waveforms of the circuit shown in FIG. 6. The operation of the plasma display panel sustain driver 601 shown in FIG. 6 will now be explained with reference to FIGS. 7A, 7B, 7C, 7D and 8.

FIG. 7A is a circuit diagram for explaining the operation of the plasma display panel sustain driver 601 according to a first mode. A bold line shown in FIG. 7A indicates a current path in the first mode. Initially, all of the MOS transistors Sf, Sr, Su and Sd are turned off, the power recovery capacitor Cd is charged to the voltage Vs/2, and a plasma display panel voltage Vp is zero. In this state, if the plasma display panel sustain driver 601 enters the first mode M1, that is, when the MOS transistor Sr is turned on, an LC resonant circuit is formed by the power recovery capacitor Cd, the MOS transistor Sr, the inductor Lr, the diode Dr and the plasma display panel 631 such that a resonant current flows through the inductor Lr. Thus, the plasma display panel voltage Vp is increased from zero to a maximum level Vpk.

FIG. 7B is a circuit diagram for explaining the operation of the plasma display panel sustain driver 601 according to a second mode. A bold line shown in FIG. 7B indicates a current path in the second mode. When the plasma display panel sustain driver 601 is in the second mode, that is, when the MOS transistor Sr is turned off and the MOS transistor Su is turned on, a sustain discharge current flows through the MOS transistor Su and the plasma display panel 631. Accordingly, the plasma display panel voltage Vp is increased to the power supply voltage Vs and maintained at this level.

At this time, a flywheel current ifc1 is generated due to a parasitic capacitance and flows through the diode Db2, the inductor Lr, the MOS transistor Sr and the power recovery capacitor Cd. The voltage Vs/2 of the power recovery capacitor Cd is applied to the inductor Lr, and the flywheel current ifc1 flowing through the inductor Lr is reduced at a rate of {Vs/(2 Lr)}.

As described above, the flywheel current ifc1 does not flow to the MOS transistor Su. Thus, the current stress on the MOS transistor Su is greatly reduced compared to the circuit shown in FIG. 1.

FIG. 7C is a circuit diagram for explaining the operation of the plasma display panel sustain driver 601 according to a third mode. A bold line shown in FIG. 7C indicates a current path in the third mode. When the plasma display panel sustain driver 601 enters the third mode, that is, when the MOS transistor Su is turned off and the MOS transistor Sf is turned on, an LC resonant circuit is formed through the plasma display panel 631, the diode Df, the inductor Lf, the MOS transistor Sf and the power recovery capacitor Cd such that a resonant current flows through the inductor Lf. Then, the plasma display panel voltage Vp is decreased by the maximum voltage Vpk.

FIG. 7D is a circuit diagram for explaining the operation of the plasma display panel sustain driver 601 according to a fourth mode. A bold line shown in FIG. 7D indicates a current path in the fourth mode. When the plasma display panel sustain driver 601 enters the fourth mode, that is, when the MOS transistor Sf is turned off and the MOS transistor Sd is turned on, a sustain discharge current flows through the plasma display panel 631 and the MOS transistor Sd. Thus, the plasma display panel voltage Vp becomes zero and is maintained at this level in the fourth mode M4.

At this time, a flywheel current ifc2 is generated due to a parasitic capacitance and flows through the power recovery capacitor Cd, the MOS transistor Sf, the inductor Lf and the diode Da2. A voltage {Vs−(Vs/2)} is applied to the inductor Lf, and the flywheel current ifc2 flowing through the inductor Lf is reduced at a rate of {Vs/(2 Lf)}.

As described above, the flywheel current ifc2 does not flow to the MOS transistor Sd. Thus, the current stress applied on the MOS transistor Sd is greatly reduced compared to the circuit shown in FIG. 1.

Figure 9:
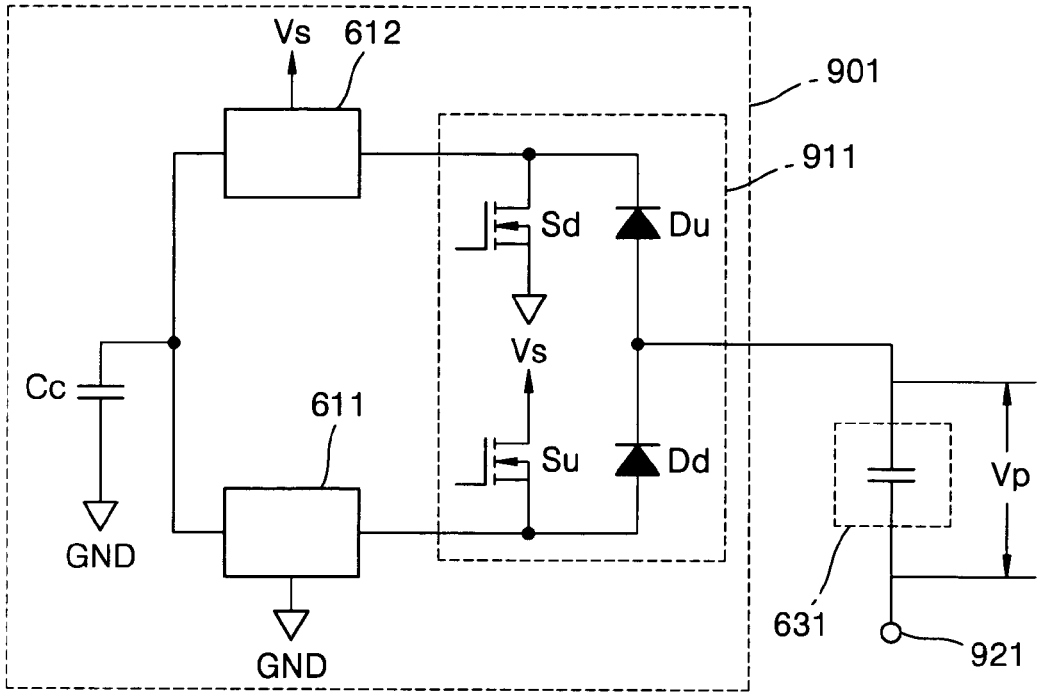
FIG. 9 is a circuit diagram of a plasma display panel sustain driver connected to a plasma display panel according to a second embodiment of the present invention.

FIG. 9 is a circuit diagram of a plasma display panel sustain driver connected to a plasma display panel according to a second embodiment of the present invention. Referring to FIG. 9, the plasma display panel sustain driver 901 includes a power recovery capacitor Cc, first and second power recovery unit 611 and 612, and a sustain switching unit 911. A terminal 921 is connected to the same device as the plasma display panel sustain driver 901.

The power recovery capacitor Cc provides a predetermined voltage to the plasma display panel 631. The sustain switching unit 911 is connected to the plasma display panel 631 and sustains or discharges a voltage of in the plasma display panel 631. The sustain switching unit 911 includes diodes Du and Dd and MOS transistors Su and Sd. The MOS transistors Su and Sd perform the same functions as the MOS transistors Su and Sd of the circuit shown in FIG. 6, respectively.

While the sustain switching unit 911 includes the diodes Du and Dd, its function is identical to that of the sustain switching unit 621 shown in FIG. 6.

While PMOS transistors can be used as the MOS transistors Su and Sd, it is preferable to use NMOS transistors as the MOS transistors Su and Sd.

The first and second power recovery unit 611 and 612 are identical to the first and second power recovery antis 611 and 612 shown in FIG. 6.

Since the operation and effects of the plasma display panel sustain driver 901 are identical to those of the plasma display panel sustain driver 601 shown in FIG. 6, except for its construction, explanations of the operation and effects of the plasma display panel sustain driver 901 are omitted.

Figure 10:
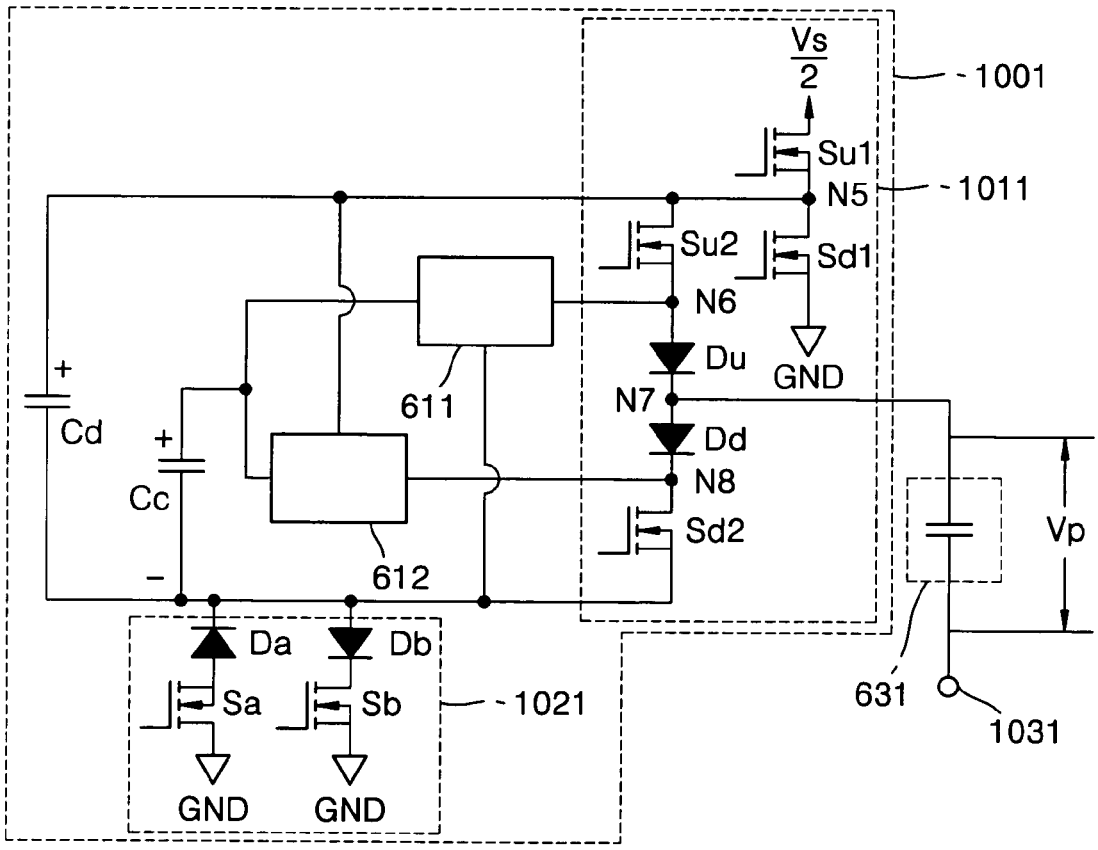
FIG. 10 is a circuit diagram of a plasma display panel sustain driver connected to a plasma display panel according to a third embodiment of the present invention.

FIG. 10 is a circuit diagram of a plasma display panel sustain driver connected to a plasma display panel according to a third embodiment of the present invention. FIGS. 11A through 11F are circuit diagrams showing current paths for modes of the circuit shown in FIG. 10. Referring to FIG. 10, the plasma display panel sustain driver 1001 includes first and second power recovery capacitors Cd and Cc, first and second power recovery units 611 and 612, a ground unit 1021, and a sustain switching unit 1011.

The first power recovery capacitor Cd stores a voltage Vs/2 and the second power recovery capacitor Cc stores a voltage Vs/4.

The sustain switching unit 1011 is connected to the plasma display panel 631, the ground unit 1021, first and second power recovery capacitors Cd and Cc. The sustain switching unit 1011 sustains or discharges a voltage charged in the plasma display panel 631.

The sustain switching unit 1011 includes a first upper MOS transistor Su1 connected between a power supply voltage Vs and a fifth node N5, a second upper MOS transistor Su2 connected between the fifth node N5 and a sixth node N6, an upper diode Du connected between the sixth node N6 and a seventh node N7, a first lower MOS transistor Sd1 connected between a ground voltage GND and the fifth node N5, a second lower MOS transistor Sd2 connected between the ground unit 1021 and an eighth node N8, and a lower diode Dd connected between the seventh node N7 and eighth node N8. The seventh node N7 is coupled to the plasma display panel 631.

The ground unit 1021 includes a first ground MOS transistor Sa and a first ground diode Da, which are serially connected to the ground voltage GND. The ground unit 1021 further includes a second ground MOS transistor Sb and a second ground diode Db, which are serially connected to the ground voltage GND. The first ground diode Da is biased toward the ground voltage GND and the second ground diode is biased away from the ground voltage GND.

Referring to FIGS. 10 and 11A-11F, the first power recovery unit 611 includes a first MOS transistor Sr connected between the second power recovery capacitor Cc and a first node, a first inductor Lr connected between the first node and a second node, a first diode D21 connected between the first node and the ground unit 1021, a second diode D22 connected between the second node and the ground unit 1021, and a third diode Dr connected between the second node and the sixth node N6 of the sustain switching unit 1011.

The first and second diodes D21 and D22 are biased toward the ground unit 1021 and the third diode Dr is biased away when seen from the ground unit 1021.

Referring to FIGS. 10 and 11A-11F, the second power recovery unit 612 includes a second MOS transistor Sf connected between the power recovery capacitor Cc and a third node, a second inductor Lf connected between the third node and a fourth node, a fourth diode D11 connected between the third node and the power supply voltage Vs, a fifth diode D12 connected between a fourth node and the power supply voltage Vs, and a sixth diode Df connected between the fourth node and the sustain switching unit 1011.

The fourth and fifth diodes D11 and D12 are biased away from the fifth node N5, and the sixth diode Df is forward biased toward the eighth node N8.

While PMOS transistors can be used as the MOS transistors Sr, Sf, Su1, Su2, Sd1, Sd2, Sa and Sb, it is preferable to use NMOS transistors as the MOS transistors Sr, Sf, Su1, Su2, Sd1, Sd2, Sa and Sb.

Figure 11A:
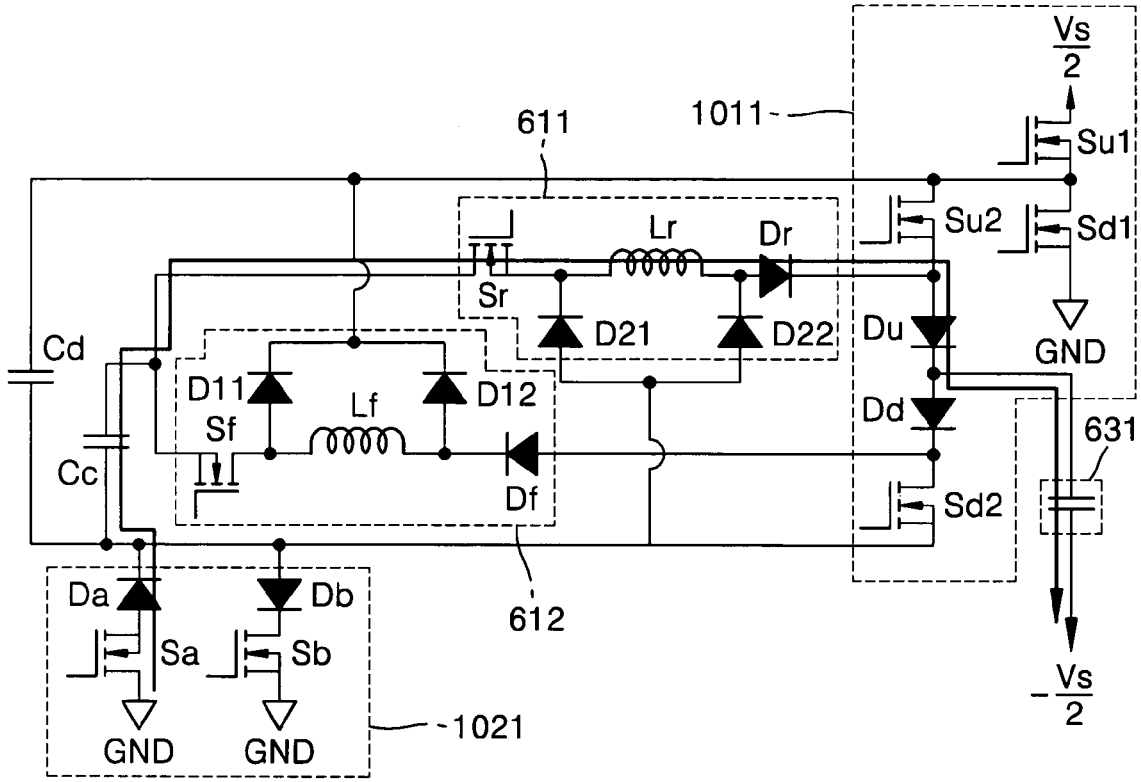
FIGS. 11A through 11F are circuit diagrams showing current paths for modes of the circuit shown in FIG. 10.
Figure 11B:
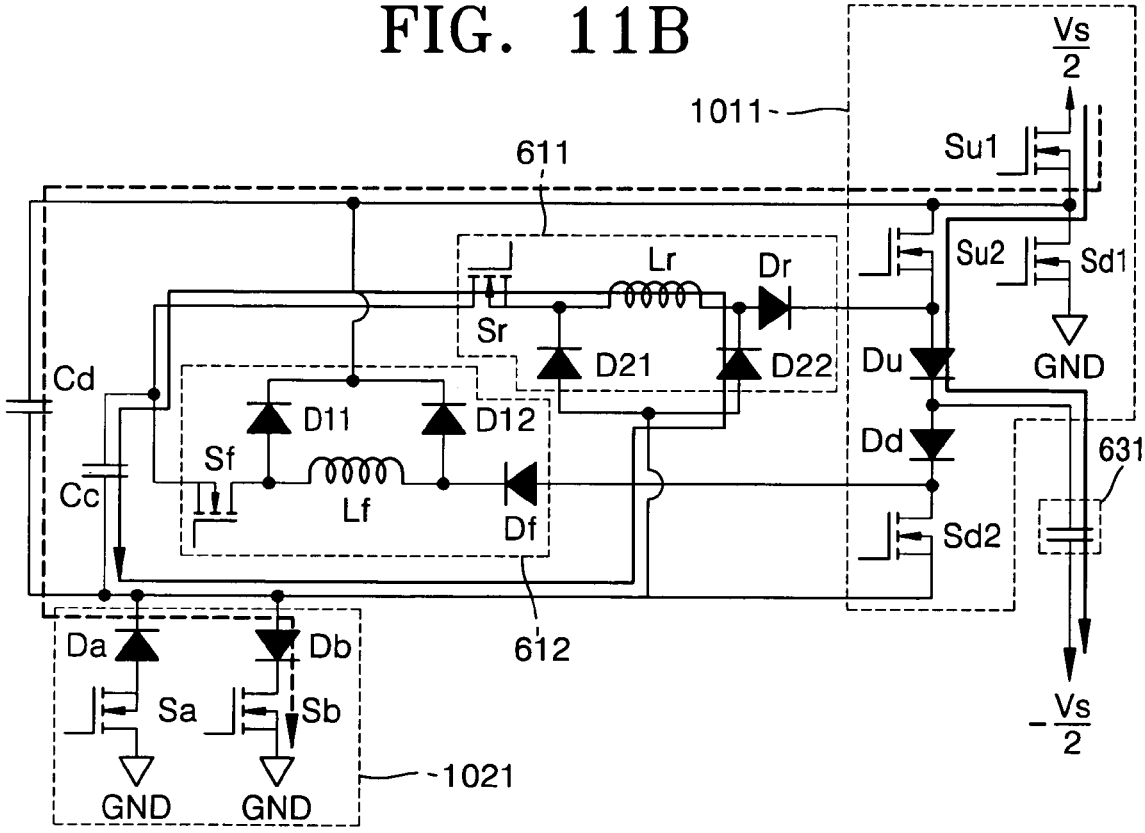
Figure 11C:
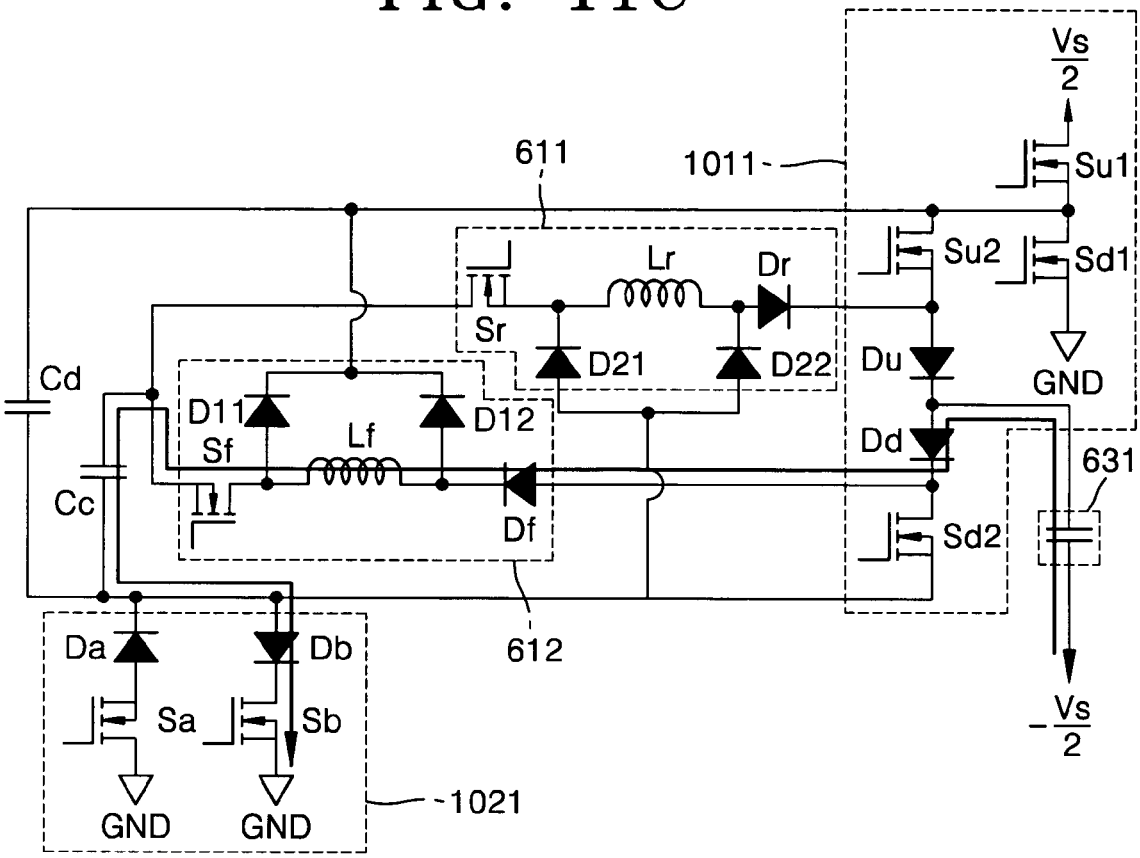
Figure 11D:
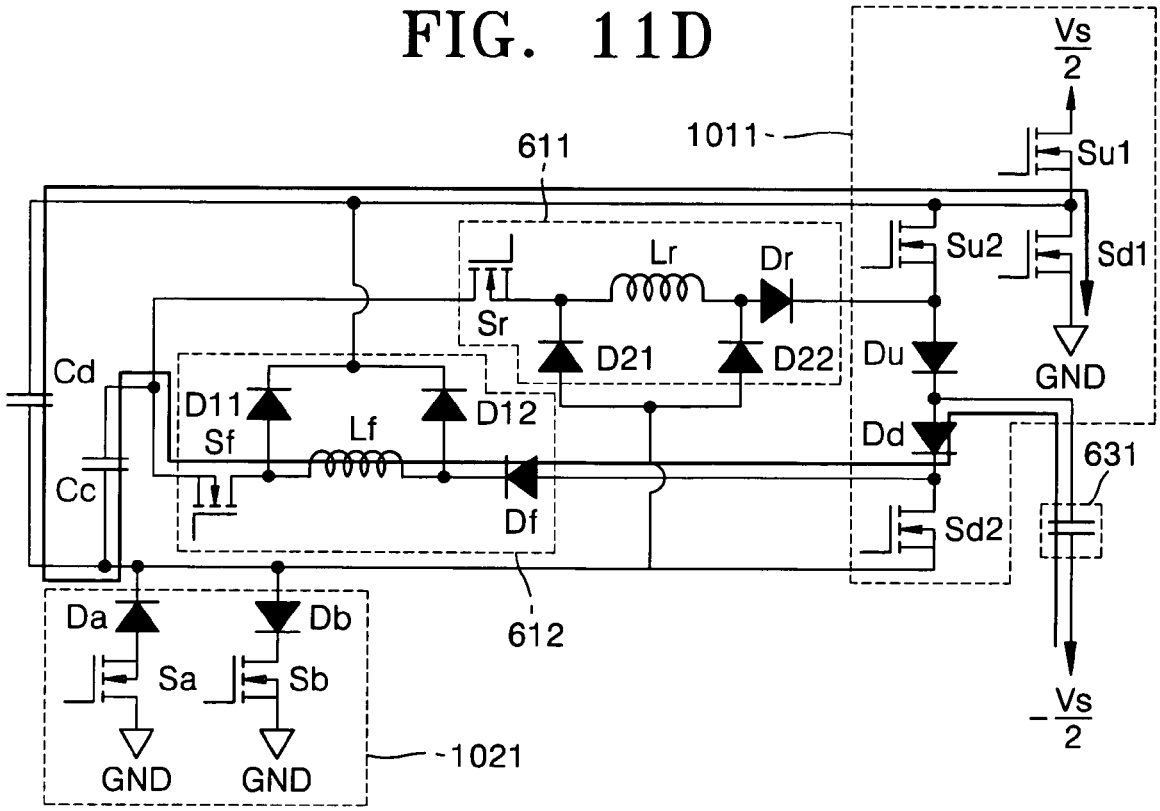
Figure 11E:
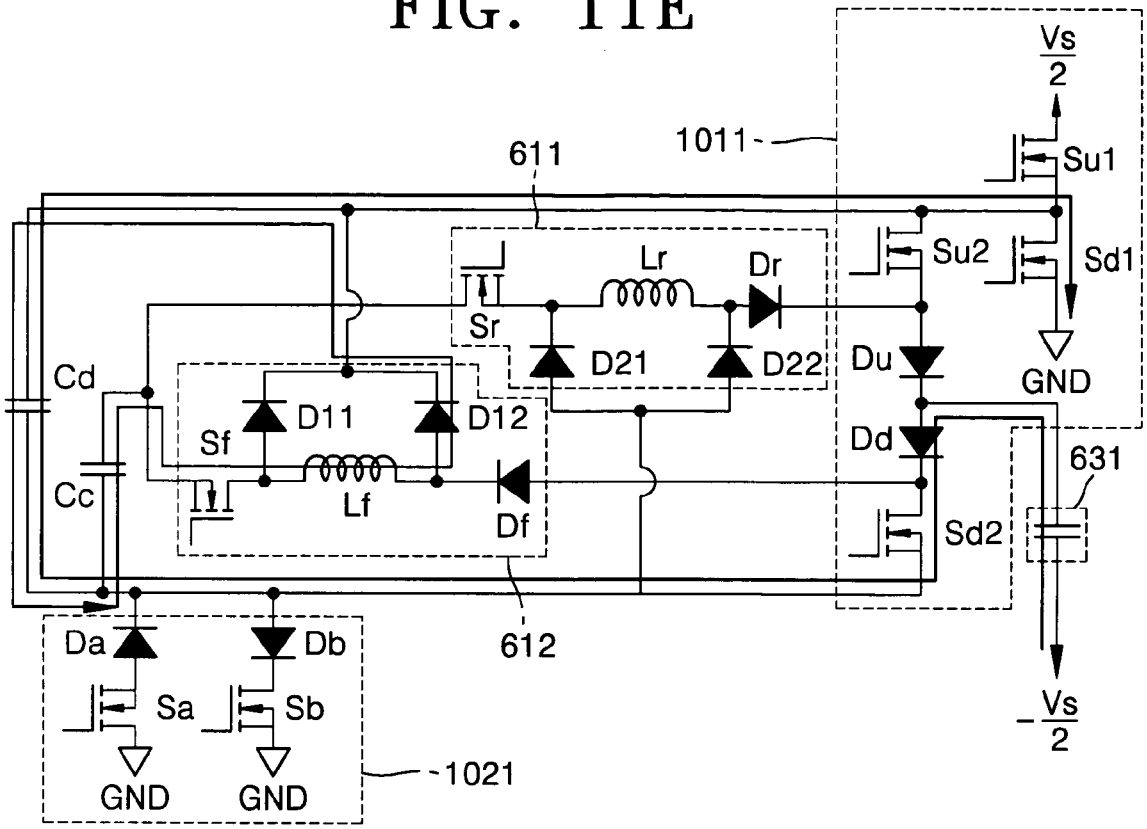
Figure 11F:
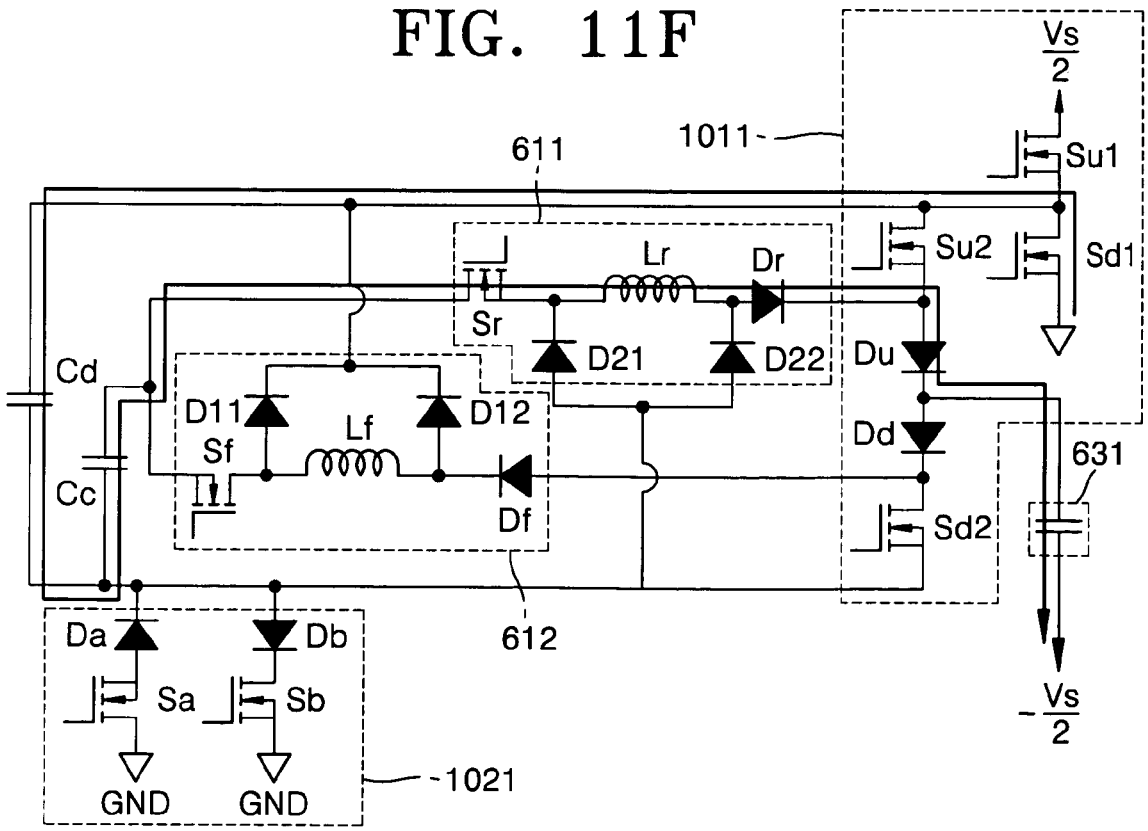
Figure 12:
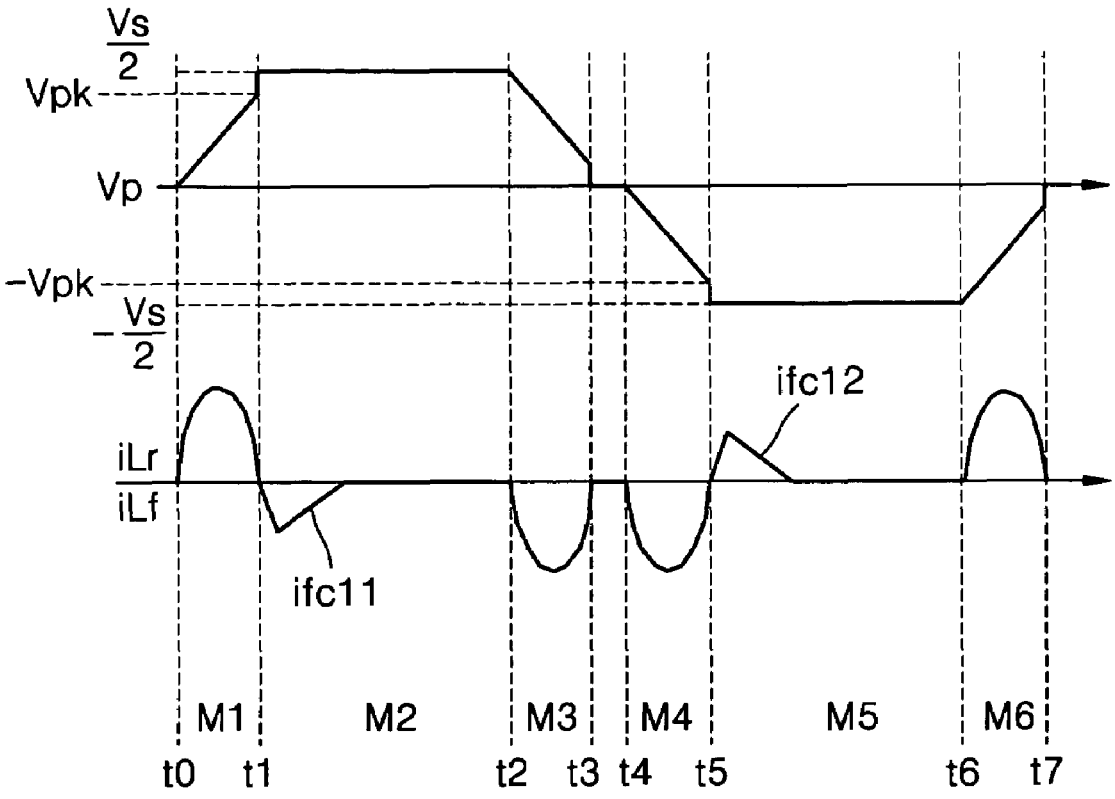
FIG. 12 shows voltage and current waveforms of the circuit shown in FIG. 10.

FIG. 12 shows voltage and current waveforms of the circuit shown in FIG. 10. The operation of the plasma display panel sustain driver 1001 shown in FIG. 10 will now be explained with reference to FIGS. 11A through 11F and 12.

FIG. 11A is a circuit diagram for explaining the operation of the plasma display panel sustain driver 1001 according to a first mode. A bold line shown in FIG. 11A indicates a current path in the first mode. Initially, all of the MOS transistors Sr, Sf, Sa, Sb, Su1, Su2, Sd1 and Sd2 and Sd are turned off, the power recovery capacitors Cd and Cc are respectively charged to predetermined voltages Vs/2 and Vs/4, and a plasma display panel voltage Vp is zero. In this state, when the plasma display panel sustain driver 1001 enters the first mode M1, that is, when the MOS transistors Sa and Sr are turned on, an LC resonant circuit is formed by the MOS transistor Sa, the diode Da, the power recovery capacitor Cc, the MOS transistor Sr, the inductor Lr, the diode Dr, the diode Du and the plasma display panel 631 such that a resonant current flows through the inductor Lr. Thus, the plasma display panel voltage Vp reaches a maximum level Vpk.

FIG. 11B is a circuit diagram for explaining the operation of the plasma display panel sustain driver 1001 according to a second mode. A bold line shown in FIG. 11B indicates a current path in the second mode. When the plasma display panel sustain driver 1001 is in the second mode, that is, when the MOS transistors Sa and Sr are turned off and the MOS transistors Su1 and Su2 are turned on, a sustain discharge current flows through the MOS transistor Su1, the MOS transistor Su2, the diode Du and the plasma display pane 631. Accordingly, the plasma display panel voltage Vp is increased to the power supply voltage Vs/2 and maintained at this level.

At this time, a flywheel current ifc11 is generated due to a parasitic capacitance and flows through the diode D22, the inductor Lr, the MOS transistor Sr, the power recovery capacitor Cc, the diode Db and the MOS transistor Sb. The voltage Vs/4 of the power recovery capacitor Cc is applied to the inductor Lr, and the flywheel current ifc11 flowing through the inductor Lr is reduced at a rate of {Vs/(4 Lr)}.

Figure 4:
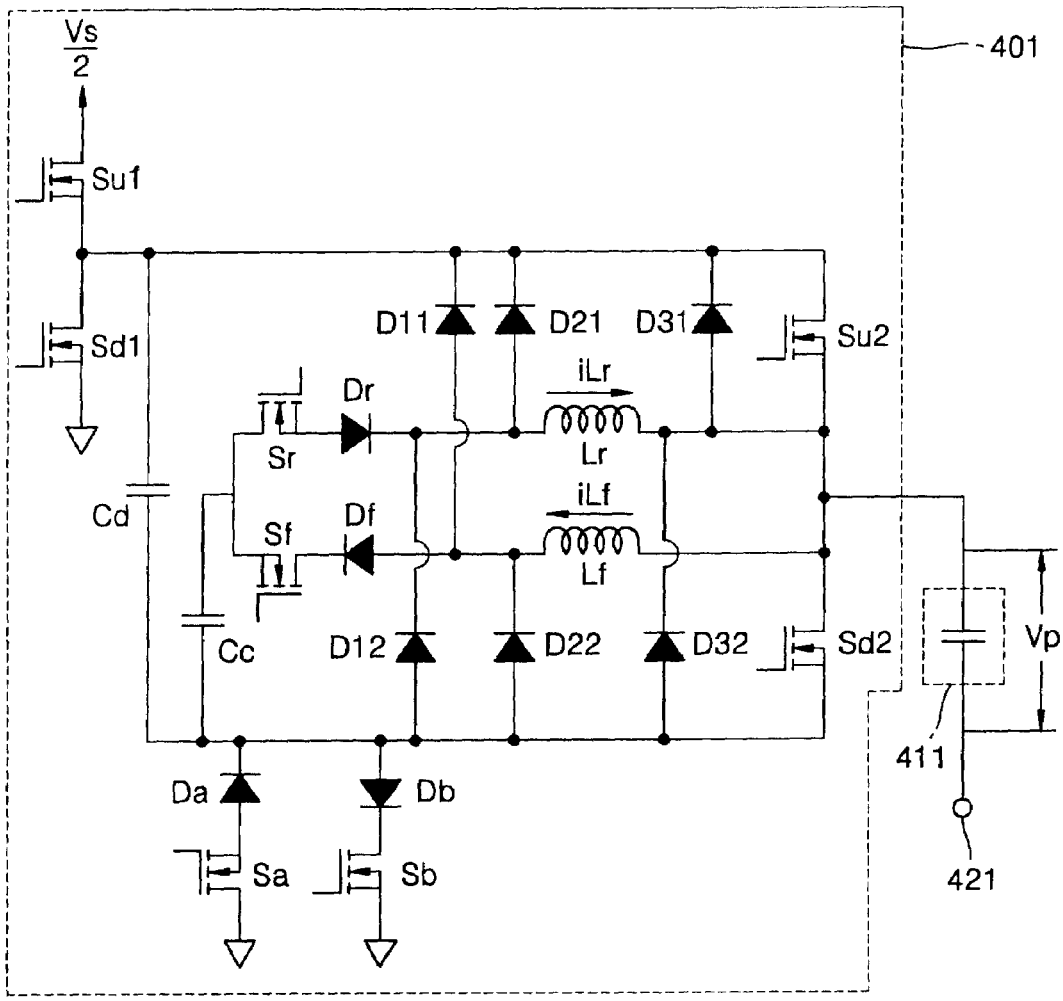
FIG. 4 is a circuit diagram of a prior art plasma display panel sustain driver connected to a plasma display panel.
Figure 5:
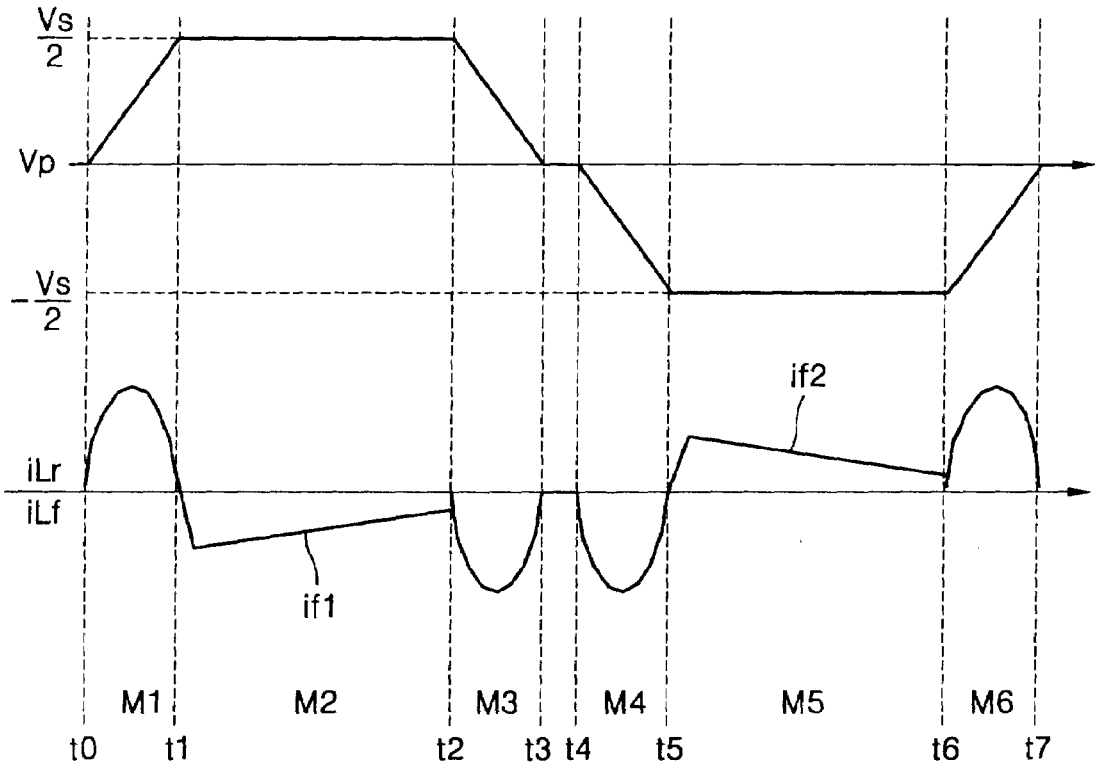
FIG. 5 shows voltage and current waveforms of the circuit shown in FIG. 4.

As described above, the flywheel current ifc11 and sustain discharge current flow along different paths. Thus, the current stress on the sustain switching unit 1011 is remarkably reduced compared to the circuit shown in FIG. 4.

In the second mode M2, the MOS transistor Sb is turned on so that the power recovery capacitor Cd is charged.

FIG. 11C is a circuit diagram for explaining the operation of the plasma display panel sustain driver 1001 according to a third mode. A bold line shown in FIG. 11C indicates a current path in the third mode. When the plasma display panel sustain driver 1001 enters the third mode, that is, when the MOS transistors Su1 and Su2 are turned off and the MOS transistors Sf and Sb are turned on, an LC resonant circuit is formed by the plasma display panel 631, the diode Dd, the diode Df, the inductor Lf, the MOS transistor Sf, the power recovery capacitor Cc, the diode Db and the MOS transistor Sb so that a resonant current flows through the inductor Lf. Thus, the plasma display panel voltage Vp is decreased to zero.

FIG. 11D is a circuit diagram for explaining the operation of the plasma display panel sustain driver 1001 according to a fourth mode. A bold line shown in FIG. 11D indicates a current path in the fourth mode. When the plasma display panel sustain driver 1001 enters the fourth mode, that is, when the MOS transistor Sb is turned off and the MOS transistor Sd1 is turned on, an LC resonant circuit is formed by the plasma display panel 631, the diode Dd, the diode Df, the inductor Lf, the MOS transistor Sf, the power recovery capacitor Cc, the power recovery capacitor Cd and the MOS transistor Sd1 such that a resonant current flows through the inductor Lf. Thus, the plasma display panel voltage Vp is decreased to −Vpk.

FIG. 11E is a circuit diagram for explaining the operation of the plasma display panel sustain driver 1001 according to a fifth mode. A bold line shown in FIG. 11E indicates a current path in the fifth mode. When the plasma display panel sustain driver 1001 enters the fifth mode, that is, when the MOS transistor Sf is turned off and the MOS transistor Sd2 is turned on, a sustain discharge current flows through the MOS transistor Sd1, the power recovery capacitor Cd, the MOS transistor Sd2, the diode Dd and the plasma display panel 631. Thus, the plasma display panel voltage Vp is decreased to the power supply voltage −Vs/2 level and maintained at this level.

At this time, a flywheel current ifc12 is generated due to a parasitic capacitance and flows through the power recovery capacitor Cc, the MOS transistor Sf, the inductor Lf, the diode D12 and the power recovery capacitor Cd. A voltage {(Vs/2)−(Vs/4)} that is obtained by subtracting the voltage of the power recovery capacitor Cc from the voltage of the power recovery capacitor Cd is applied to the inductor Lf. The flywheel current ifc12 flowing through the inductor Lf is reduced at a rate of {−Vs/(4 Lf)}.

As described above, the flywheel current ifc12 and sustain discharge current flow through different paths. Thus, the current stress on the sustain switching unit 1011 is remarkably reduced compared to the circuit shown in FIG. 4.

FIG. 11F is a circuit diagram for explaining the operation of the plasma display panel sustain driver 1001 according to a sixth mode. A bold line shown in FIG. 11F indicates a current path in the sixth mode. When the plasma display panel sustain driver 1001 enters the sixth mode, that is, when the MOS transistor Sd2 is turned off and the MOS transistor Sr is turned on, an LC resonant circuit is formed through the MOS transistor Sd1, power recovery capacitor Cd, the power recovery capacitor Cc, the MOS transistor Sr, the inductor Lr, the diode Dr, the diode Du and the plasma display panel 631 such that a resonant current flows through the inductor Lr. Thus, the plasma display panel voltage Vp is increased from −Vs/2 to zero.

As described above, according to the present invention, the flywheel current flowing through inductors is remarkably reduced thereby decreasing the current stress on the sustain switching unit. This also allows for the size of the MOS transistors included in the sustain switching unit to be decreased. As a result, the size and cost of the plasma display panel sustain driver are reduced and power consumption of the plasma display panel sustain driver is also decreased.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel sustain driver that drives a plasma display panel, comprising:

a power recovery capacitor that provides a predetermined voltage to the plasma display panel;

a sustain switching unit that is connected to the plasma display panel and sustains or discharges the voltage charged in the plasma display panel;

a first power recovery unit connected between the power recovery capacitor and the sustain switching unit, the first power recovery unit forming a resonant circuit together with the plasma display panel to provide a voltage stored in the power recovery capacitor to the plasma display panel through the sustain switching unit when the sustain switching unit is deactivated, the first power recovery unit blocking an output current of the sustain switching unit when the sustain switching unit is activated; and a second power recovery unit connected between the power recovery capacitor and the sustain switching unit, the second power recovery unit forming a resonant circuit together with the plasma display panel to discharge a voltage stored in the plasma display panel to the power recovery capacitor when the sustain switching unit is deactivated, the second power recovery unit blocking a current path to the sustain switching unit when the sustain switching unit is activated, wherein the first power recovery unit comprises:

a first MOS transistor connected between the power recovery capacitor and a first node;

a first inductor connected between the first node and a second node;

a first diode connected between the first node and a ground voltage;

a second diode connected between the second node and the ground voltage; and a third diode connected between the second node and the sustain switching unit.

2. The plasma display panel sustain driver of claim 1, wherein the sustain switching unit includes an upper MOS transistor connected to a power supply voltage and a lower MOS transistor connected to a ground voltage, and wherein further a current flows from the upper MOS transistor to the plasma display panel when the upper MOS transistor is turned on, and a current flows from the plasma display panel to the lower MOS transistor when the lower MOS transistor is turned on.

3. The plasma display panel sustain driver of claim 1, wherein the second power recovery unit comprises:

a second MOS transistor connected between the power recovery capacitor and a third node;

a second inductor connected between the third node and a fourth node;

a fourth diode connected between the third node and a power supply voltage;

a fifth diode connected between the fourth node and the power supply voltage; and a sixth diode connected between the fourth node and the sustain switching unit.

4. The plasma display panel sustain driver of claim 1, wherein only the first MOS transistor, the first inductor, and the first diode are connected to the first node.

5. A plasma display panel sustain driver that drives a plasma display panel, comprising:

a power recovery capacitor that provides a predetermined voltage to the plasma display panel;

a sustain switching unit that is connected to the plasma display panel and sustains or discharges the voltage stored in the plasma display panel;

a first power recovery unit comprising a first MOS transistor connected between the power recovery capacitor and a first node, a first inductor connected between the first node and a second node, a first diode connected between the first node and a ground voltage, a second diode connected between the second node and the ground voltage, and a third diode connected between the second node and the sustain switching unit, the first and second diodes being biased toward the ground voltage, the third diode being biased away from the sustain switching unit; and a second power recovery unit comprising a second MOS transistor connected between the power recovery capacitor and a third node, a second inductor connected between the third node and a fourth node, a fourth diode connected between the third node and a power supply voltage, a fifth diode connected between the fourth node and the power supply voltage, and a sixth diode connected between the fourth node and the sustain switching unit, the fourth and fifth diodes being biased away from the power supply voltage, and the sixth diode being biased toward the sustain switching unit.

6. The plasma display panel sustain driver of claim 5, wherein the first and second MOS transistors are NMOS transistors.

7. The plasma display panel sustain driver of claim 5, wherein the sustain switching unit includes an NMOS transistor connected between the power supply voltage and the plasma display panel, and an NMOS transistor connected between the ground voltage and the plasma display panel.

8. A plasma display panel sustain driver that drives a plasma display panel, comprising:

a power recovery capacitor that provides a predetermined voltage to the plasma display panel;

a sustain switching unit that is connected to the plasma display panel and sustains or discharges a voltage stored in the plasma display panel;

a first power recovery unit comprising a first MOS transistor connected between the power recovery capacitor and a first node, a first inductor connected between the first node and a second node, a first diode connected between the first node and a ground voltage, a second diode connected between the second node and the ground voltage, and a third diode connected between the second node and the sustain switching unit, the first and second diodes being biased toward the ground voltage, the third diode being biased away from the sustain switching unit; and a second power recovery unit comprising a second MOS transistor connected between the power recovery capacitor and a third node, a second inductor connected between the third node and a fourth node, a fourth diode connected between the third node and a power supply voltage, a fifth diode connected between the fourth node and the power supply voltage, and a sixth diode connected between the fourth node and the sustain switching unit, the fourth and fifth diodes being biased away from the power supply voltage, and the sixth diode being biased toward the sustain switching unit, wherein the sustain switching unit comprises a lower MOS transistor connected between the third diode and the power supply voltage, a lower diode connected between the third diode and the plasma display panel, an upper MOS transistor connected between the sixth diode and the ground voltage, and an upper diode connected between the sixth diode and the plasma display panel.

9. The plasma display panel sustain driver of claim 8, wherein each of the first, second, upper and lower MOS transistors is an NMOS transistor.

10. The plasma display panel sustain driver of claim 8, wherein the lower diode is biased away from the plasma display panel and the upper diode is biased toward the plasma display panel.

11. A plasma display panel sustain driver that drives a plasma display panel, comprising:

first and second power recovery capacitors that provide predetermined voltages;

a ground unit that provides a ground voltage;

a sustain switching unit that is connected to the plasma display panel, the ground unit, and the first and second power recovery capacitors and sustains or discharges a voltage stored in the plasma display panel;

a first power recovery unit including a first MOS transistor connected between the first and second power recovery capacitors and a first node, a first inductor connected between the first node and a second node, a first diode connected between the first node and the ground unit, a second diode connected between the second node and the ground unit, and a third diode connected between the second node and a sixth node of the sustain switching unit, the first and second diodes being biased toward the ground unit, the third diode being biased away from the sixth node of the sustain switching unit; and a second power recovery unit comprising a second MOS transistor connected between the first and second power recovery capacitors and a third node, a second inductor connected between the third node and a fourth node, a fourth diode connected between the third node and a fifth node of the sustain switching unit, a fifth diode connected between the fourth node and the fifth node of the sustain switching unit, and a sixth diode connected between the fourth node and an eighth node of the sustain switching unit, the fourth and fifth diodes being biased away from the fifth node of the sustain switching unit, the sixth diode being biased toward the eighth node of the sustain switching unit, wherein the sustain switching unit includes a first upper MOS transistor connected between a power supply voltage and the fifth node, a second upper MOS transistor connected between the fifth and sixth nodes, an upper diode connected between the sixth node and a seventh node, a first lower MOS transistor connected between the ground voltage and the fifth node, a second lower MOS transistor connected between the ground unit and the eighth node, and a lower diode connected between the seventh and eighth nodes, and the seventh node is connected to the plasma display panel.

12. The plasma display panel sustain driver of claim 11, wherein the first power recovery capacitor is connected between the fifth node and the ground unit, and the second power recovery capacitor is connected between the first and second power recovery units and the ground unit.

13. The plasma display panel sustain driver of claim 11, wherein each of the first and second upper MOS transistors, and the first and second lower MOS transistors is an NMOS transistor.

14. The plasma display panel sustain driver of claim 11, wherein the ground unit includes a first ground MOS transistor and a first ground diode serially connected to the ground voltage, and a second ground MOS transistor and a second ground diode serially connected to the ground voltage, the first ground diode being biased toward the ground voltage and the second ground diode being biased away when seen from the ground voltage, and the first and second ground MOS transistors are NMOS transistors.

15. A driver that drives a display panel, the driver comprising:

a power circuit that provides a voltage to the display panel;

a switching circuit that is connected to the display panel and sustains or discharges the voltage charged in the display panel;

a first power recovery circuit connected between the power circuit and the switching circuit; and a second power recovery circuit connected between the power circuit and the switching circuit, wherein the first power recovery circuit comprises:

a first switch connected between the power circuit and a first node;

a first inducting circuit connected between the first node and a second node;

a first diode connected between the first node and a ground voltage;

a second diode connected between the second node and the ground voltage; and a third diode connected between the second node and the switching circuit, wherein only the first switch, the first inducting circuit, and the first diode are connected to the first node.

16. The driver of claim 15, wherein the switching circuit includes an upper MOS transistor connected to a power supply voltage and a lower MOS transistor connected to a ground voltage, and wherein further a current flows from the upper MOS transistor to the plasma display panel when the upper MOS transistor is turned on, and a current flows from the plasma display panel to the lower MOS transistor when the lower MOS transistor is turned on.

17. The driver of claim 15, wherein the second power recovery circuit comprises:

a second switch connected between the power circuit and a third node;

a second inducting circuit connected between the third node and a fourth node;

a fourth diode connected between the third node and a power supply voltage;

a fifth diode connected between the fourth node and the power supply voltage; and a sixth diode connected between the fourth node and the switching circuit.

* * * * *